US007576274B1

(12) United States Patent
Frisch et al.

(10) Patent No.: US 7,576,274 B1
(45) Date of Patent: Aug. 18, 2009

(54) CHINREST DEVICE FOR MUSICAL INSTRUMENT, METHOD AND KIT

(76) Inventors: Gary Frisch, 3008 Westcott St., Falls Church, VA (US) 22042; Lynne Denig, 4900 Bexley La., Fairfax, VA (US) 22032

( * ) Notice: Subject to any disclaimer, the term of this patent is extended or adjusted under 35 U.S.C. 154(b) by 0 days.

(21) Appl. No.: 12/022,566

(22) Filed: Jan. 30, 2008

(51) Int. Cl.
*G10D 1/02* (2006.01)

(52) U.S. Cl. ..... 84/279

(58) Field of Classification Search ..... 84/274–281
See application file for complete search history.

(56) References Cited

U.S. PATENT DOCUMENTS

| | | | | |
|---|---|---|---|---|
| 1,204,642 | A | 11/1916 | Becker | |
| 1,225,566 | A | 5/1917 | Boles | |
| 2,486,646 | A | 11/1949 | Halko | |
| 3,683,098 | A * | 8/1972 | Chavez, Jr. | 84/278 |
| D390,252 | S | 2/1998 | Burward-Hoy et al. | |
| 6,927,328 | B2 | 8/2005 | Anderson | |
| 2006/0207405 | A1 | 9/2006 | Armstrong et al. | |

OTHER PUBLICATIONS

"Chinrest Choice Based on Jaw Type," by Lynne Denig and Gary Frisch, appearing in American String Teacher, Feb. 2007, pp. 46-52.
"The Influence of Neck-Shoulder Pain on Trapezius Muscle Activity Among Professional Violin and Viola Players: An Electromyographic Study," by Patrice Berque, B.Sc. (Hons), S.R.P. et al., appearing in Medical Problems of Performing Artists, Jun. 2002, pp. 68-75.

* cited by examiner

*Primary Examiner*—Kimberly R Lockett
(74) *Attorney, Agent, or Firm*—Fitch Even Tabin & Flannery; John M. Naber

(57) ABSTRACT

Instrument chinrest device, method, and kit customized as to proper height, rigidity, shape, size, and placement. An assembled chinrest can include a topper having pins; a lift having lift topper holes corresponding to receive said topper pins and at least one lift hardware attachment hole; and lift hardware having at least one threaded barrel configured to receive at one end a first end of an upper lift threaded member and configured to receive at a second end a lower lift threaded member, said upper lift threaded member having a second end to attached within said lift hardware attachment hole whereby, when attached to said lift, the device is able to be clamped onto a top plate and bottom plate of the instrument. The kit can include a plurality of toppers and lifts to select from, as well as the tools to determine proper chinrest placement and shape.

13 Claims, 12 Drawing Sheets

CHINREST DEVICE FOR MUSICAL INSTRUMENT, METHOD AND KIT

CLAIM OF PRIORITY

None.

FIELD OF THE INVENTION

The present invention generally relates to a chinrest device for a musical instrument and, specifically, to a chinrest for a user of a violin or viola that is customized as to proper height, shape, size, and placement of the chinrest, as well as the system and method to achieve this customized fit.

BACKGROUND OF INVENTION

At the beginning of the eighteenth century, a new virtuosity emerged in the world of violin and viola playing requiring players of these instruments to move their left hand towards and away from their body while playing (known as shifting) in greater extremes. Greater shifting movements required that instrumentalists seek ways to stabilize their violin or viola against their neck.

A very early solution was the chinrest, a disk-shaped plate of wood mounted under the player's jaw on the instrument. The role that properly-fitted chinrests presently play in player health has largely been overlooked, left to chance, and dictated by fashion. Players who have very short or very long necks and arms contort themselves to accommodate violin or viola placement that is too high or too low under their jaw or too far right or left of the instrument center. Additionally, players and teachers are known to randomly try chinrests that are placed on the left side (called "left-mounted chinrest") of the violin or viola or at the center (called "center-mounted chinrests") of the instrument without understanding the conditions of use for either kind of chinrest. Fashion and teacher preference, rather than ergonomics, can often dictate "solutions" to these problems.

Additionally, the actual shape of the chinrest cup has largely been ignored in the art, sometimes resulting in a host of skin problems due to improperly matching of chinrest contour to jaw shape. If one likened proper chinrest fit to proper shoe fit, one could say that comfort and "wear-ability" are dictated by successfully finding a good fit in both. Not only must a shoe be long enough, but the width and arch placement of the shoe should be close to the contour of the foot. In chinrest jargon, the chinrest must be high enough and the shape of the top side of the chinrest under the jaw close to the contour of the jaw. Even more basic is guiding people on which shoe goes on which foot. In chinrest terms, teachers and players are not quite sure whether they need a left-mounted chinrest or a center-mounted chinrest. These befuddlements are the cause of many playing-related physical problems in violinists and violists.

Another relatively recent solution to fitting a violin or viola to a player was the addition of a shoulder pad (sometimes called a "shoulder rest"). Usually a rigid structure and not unlike a very small, inverted, short-legged coffee table with rubberized feet, hard shoulder pads are fastened on the collarbone side of the instrument, with the "table surface" resting across the player's left collarbone and breastbone. Using these, violinists and violists were then able to achieve some degree of stabilization and, in many cases, too much. The combined effect of ill fitting chinrests, over-stabilization from hard shoulder pads, lack of emphasis on posture and positioning of the instrument, plus the demands of modern playing have helped violinists and violists achieve infamy in medical journals. It is commonly known in the art that these problems cause overuse injuries plus neck, shoulder, and lower back strain in players of these instruments. Many state that sixty-six percent of players of violin and viola today play in pain. See, "The Influence of Neck-Shoulder Pain on Trapezius Muscle Activity among Professional Violin and Viola Players: An Electomyographic Study by Patrice Pergue, Heather Gray." Medical Problems of Performing Artists, Volume 17, page 68, 2002.

Because the violin and viola are typically placed on the left side of the body between the collarbone and left jaw, muscles and nerves serving the left shoulder girdle are typically implicated in instrument support and, thus, the most notorious sites of pain and injury. Most teachers are at a loss as to how to solve chinrest fitting issues and, consequently, resorting to a hard shoulder pad is the usual path taken even for young children and adolescents. Unfortunately, it appears that hard shoulder pads compound physical problems by directing support of the instrument to the left shoulder rather than to the spine, the body's main system of support. Also, hard shoulder pads demand a change in bow and left hand technique due to the over-tilting of the instrument. Hard shoulder pads also rarely solve the tendency of "scroll droop," where the strings are no longer horizontal to the floor, causing tonal problems. Also, children with an instrument and shoulder pad combination that are too high for their neck height unnaturally deform their bodies to hold the instrument.

People understand how important a good-fitting shoe is to day-to-day comfort, discarding shoes whose pressure points and poor shape cause blisters, bunions, and deformities of the foot. Discomfort and resulting medical problems for violinists and violists have been tolerated, quietly endured, or have prematurely and unnecessarily ended careers of many players. This can come about because players have strong allegiances to teachers who insist that students "wear" their model of chinrest and shoulder pad. Other reasons for this quiet misery can be fashion and status: if a well-known artist uses a certain shoulder pad and chinrest combination, other players may think this combination will also help them to play well. Regional preferences also exist; violin shops fit their instruments with one model, and teachers and students think that this is what one must have.

Because violin or viola lessons can begin as early as age three, these same problems also extend to children. To continue the shoe analogy: in the shoe industry, within the last twenty years, the necessity of proper shoe fit for children and shoe design based on this need has finally been established. In the chinrest world, proper fitting of chinrests for children is still largely ignored. Teachers of these young players often ignore the importance of good fit, try to fit them with an adult-style shoulder pad or, in the case of those teachers who do realize the importance of good fit, give up in frustration that there is so little available for their young students. In one currently available mail order catalog, there are eight sizes of violins: 4/4, 7/8, 3/4, 1/2, 1/4, 1/8, 1/10, 1/16, and 1/32. Curiously, all these size variations are typically accompanied by one shape of chinrest. It becomes obvious, then, that teachers, players, and manufacturers are assuming that what suits adults should suit children, or that children do not need the same variety as adults.

Young children typically keep the same shape of their jaw for life despite its growth in size as they age into adulthood. The variety of chinrest shapes available for full-size instruments should also be available to young students. More importantly, these chinrests should be shaped with defined ridges necessary for secure, comfortable, and ergonomic fit.

Continuing the shoe metaphor: the shoe world has long had shoe measuring devices that help shoe shoppers decide on an appropriate fit, but so far, nothing like this has been found in the violin/viola world for chinrest fitting.

Rudimentary devises are known in the art to address making some adjustment in chinrests for instruments. For example, U.S. Pat. No. 1,204,642 to Becker describes a raiseable and tiltable chinrest, but the shape cannot be changed. Also, U.S. Pat. No. 1,222,566 to Boles and U.S. Pat. No. 2,486,646 to Halko both show built-in raising devices in the chinrest, but nothing to change the shape. Fractional sizes are not mentioned.

More recent patents, such as U.S. Pat. No. 4,534,259 to Wolf and U.S. Pat. No. 4,719,835 to Biasini, describe chinrest shape but not height, and D390,252 to Burward-Hoy shows a seemingly higher chinrest, but the shape is static. Again, fractional sizes are not mentioned. In none of the patents is there a device to diagnose left or center placement of the chinrest.

Thus, despite attempts, the prior art fails to provide optimal chinrests for a user. Further, no such devices or methods for proper fitting of a violin chinrest are known in the art to address height, shape, size and placement for a truly custom fit. Thus, there is a desire and a need in the art to provide a properly fitted chinrest for a violin or viola and a method and system for the development of such a chinrest. Such a device and method would greatly aid in the comfort, health, and enjoyment of the player of such instruments, as well as potentially increase the desirability and popularity of playing them.

BRIEF DESCRIPTION OF THE FIGURES

The foregoing features, as well as other features, will become apparent with reference to the description and figures below, in which like numerals represent elements and in which.

SUMMARY OF INVENTION

Figure 1:
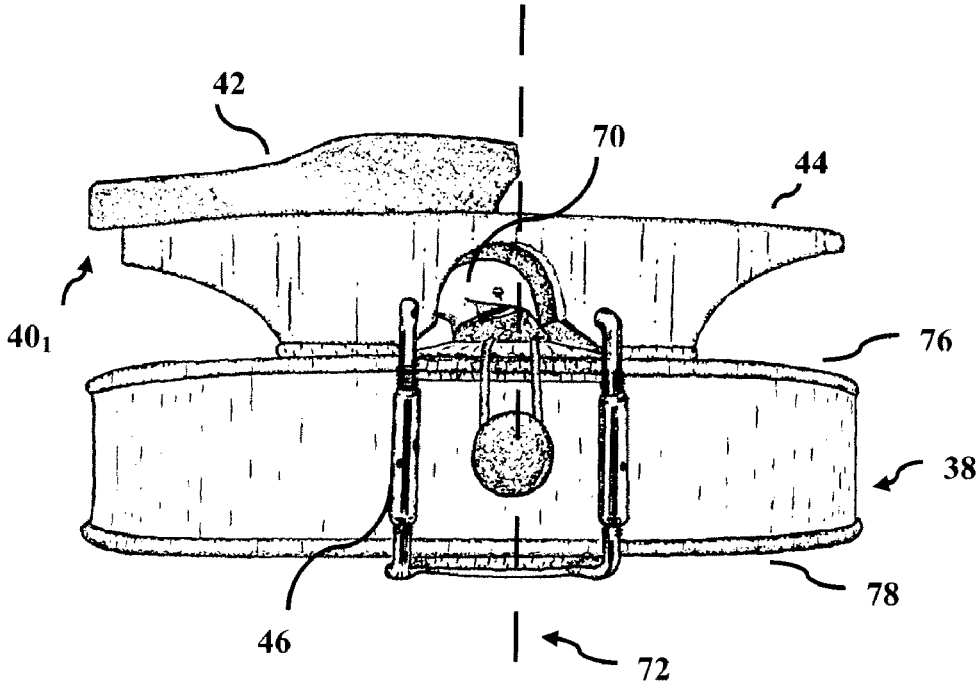
FIG. 1 illustrates a back view, center-mounted lift of one embodiment of a device of the present invention.

Accordingly, the present invention provides an optimal chinrest for a player of a violin or viola that is customized as to proper height, rigidity, shape, size, and placement of the chinrest, as well as the system and method to achieve this customized fit. Chinrests should be selected with defined ridges necessary for secure, comfortable, and ergonomic fit.

One embodiment of the present invention can include an assembled chinrest device for a musical instrument customized to proper height, shape, size, and placement of the chinrest, having a topper having at least two topper pins; a lift having lift topper holes corresponding to receive said topper pins and at least one lift hardware attachment hole; and lift hardware having at least one threaded barrel configured to receive at one end a first end of an upper lift threaded member and configured to receive at a second end a lower lift threaded member, said upper lift threaded member having a second end attached within said lift hardware attachment hole, whereby when attached to said lift, the device is able to be clamped onto a top plate and bottom plate of the instrument.

Additional features of the present invention can include an elastic band to attach said device to said instrument, cork to place between where the instrument and the device make contact, and an arch on the lift whereby the device can be placed over the center of the instrument without contacting an instrument's strings or bridge.

Another embodiment of the present invention includes a kit to assemble a chinrest device for a musical instrument customized to proper height, shape, size, and placement of the chinrest having a plurality of toppers based on various jaw configuration possibilities for a user, said toppers having at least one pin; a plurality of lifts to allow selection of height of the chinrest, said lifts also varied to allow placement around the left or center of the instrument, said lifts having a plurality of holes or hole sets to allow various attachment points of said topper; lift hardware to attach said lifts to said instrument, including at least one threaded barrel configured to receive at one end a first end of an upper lift threaded member and configured to receive at a second end a lower lift threaded member, said upper lift threaded member having a second end to attach within said lift hardware attachment hole; a carrying case; a tape measure; a cosmetic sponge; at least one elastomeric band; a barrel key; and cork.

Additional features of the present invention kit can include a camera.

Another embodiment of the present invention includes a method to assemble a chinrest device for a musical instrument customized to proper height, shape, size, and placement of the chinrest from a kit, having the steps of determining whether a center-mounted or left-mounted chinrest is most appropriate for a user of an instrument; measuring a user's neck from bottom of left jaw to top of the left collarbone to obtain a neck height; measuring the instrument from the top of the top plate to the bottom of the bottom plate to obtain an instrument height; subtracting instrument height from neck height; assembling a trial chinrest with a test topper from kit having a plurality of toppers, a lift approximately 20 mm less than the number obtained from subtracting the instrument height from neck height when combined with said topper, and lift hardware to allow attachment of trial chinrest to said instrument; attaching said trial chinrest to the instrument; choosing a topper by analyzing fit and comfort for height and contour of the chin; and choosing a lateral attachment point of said topper to said lift, considering the flexibility of the user's left arm and the length of the smallest finger of the player.

Additional features of the present invention method can include removing an old chinrest and shoulder rest if present; manufacturing a finished device as a single, one-piece unit having the proper height, rigidity, shape, size, and lift to allow proper placement on the instrument; and photographing a user with a camera.

Other features of the present invention will become more apparent to persons having ordinary skill in the art to which the present invention pertains from the following description and claims.

DETAILED DESCRIPTION OF THE INVENTION

The present invention generally relates to a chinrest device for a musical instrument and, specifically, to a chinrest for a user of a violin or viola that is customized as to proper height, shape, size, and placement of the chinrest, as well as the system and method to achieve this customized fit. As part of this process, attention to posture, positioning, age, size, and instrument of the user are considered.

Figure 2:
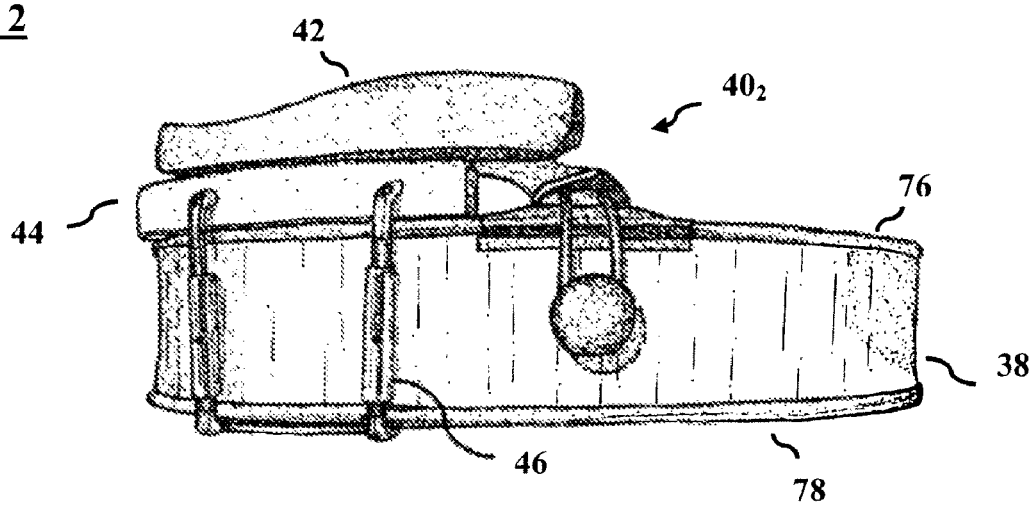
FIG. 2 illustrates a back view, left-mounted lift of one embodiment of a device of the present invention.
Figure 3:
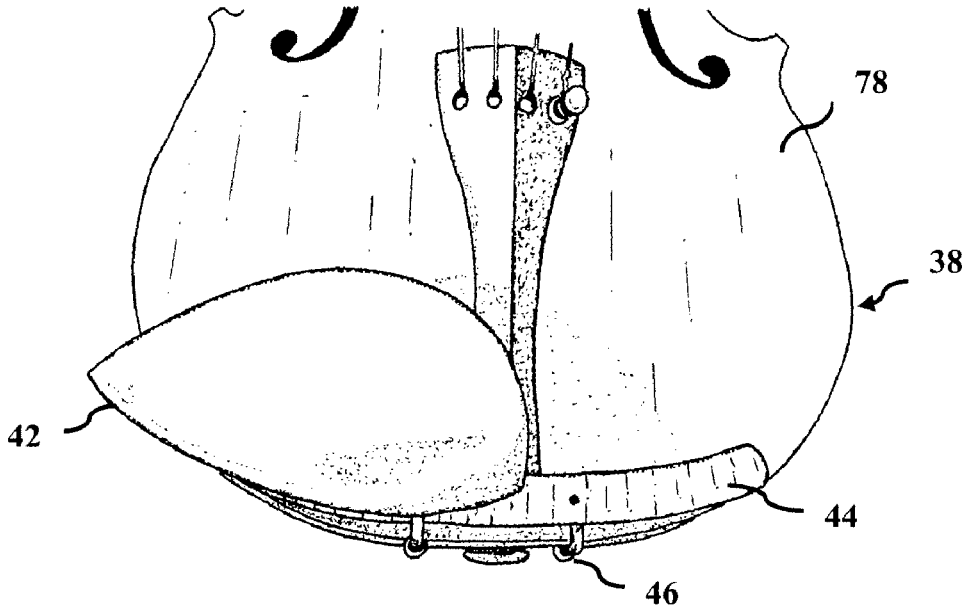
FIG. 3 illustrates a top view, center-mounted lift of one embodiment of a device of the present invention.
Figure 4:
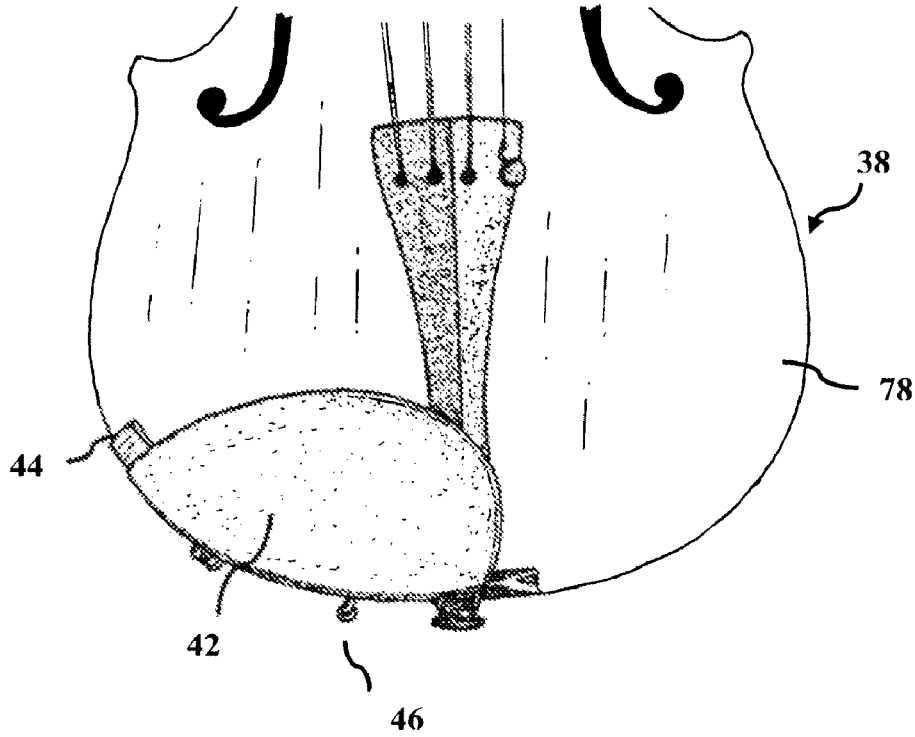
FIG. 4 illustrates a top view, left-mounted lift of one embodiment of a device of the present invention.
Figure 22:
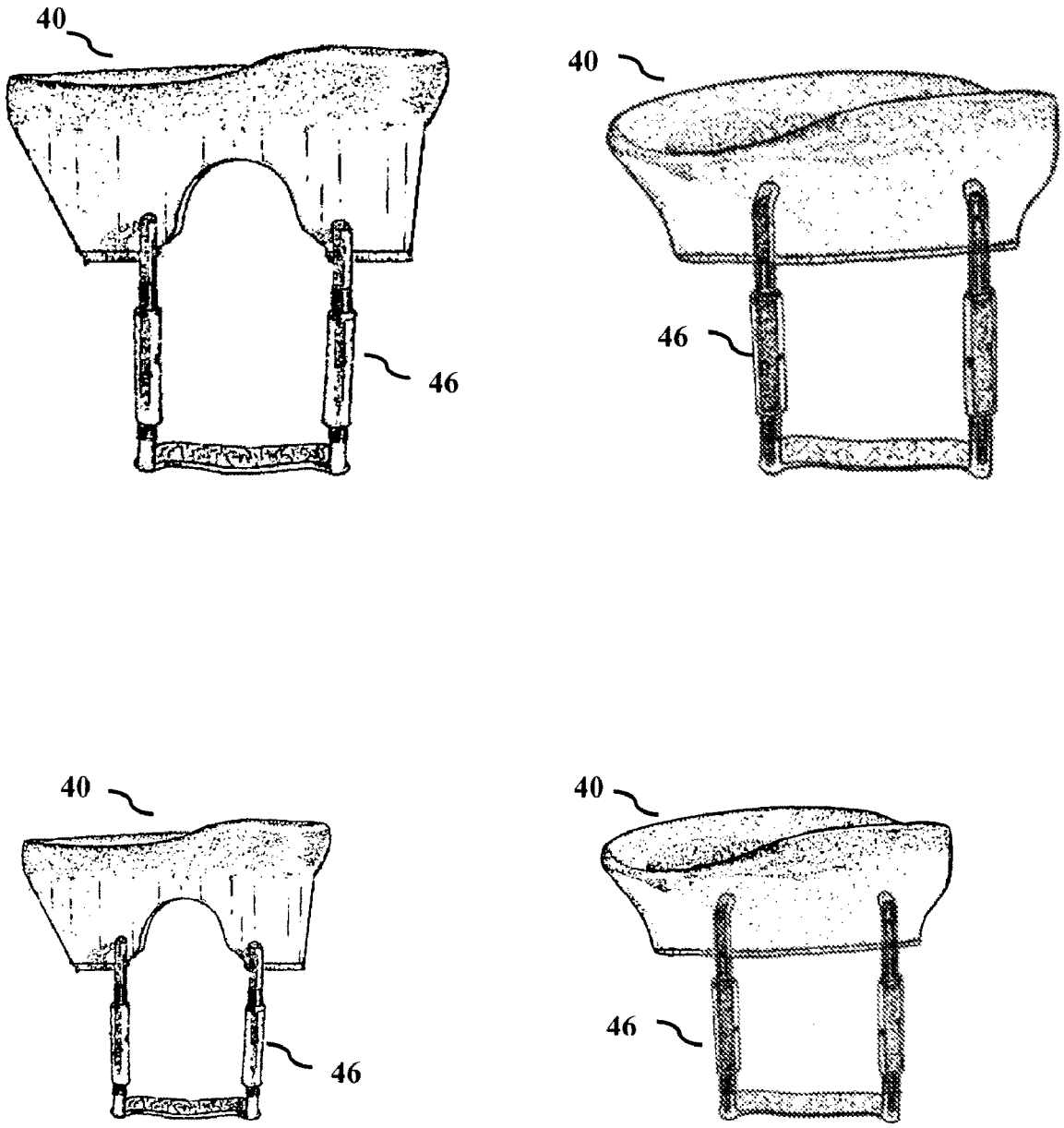
FIG. 22 illustrates a finished product, adult size and child size, of one embodiment of a device of the present invention.

Referring now to the figures, namely FIGS. 1 and 2 show a chinrest device 40 of the present invention on a stringed instrument 38 (such as a violin or viola) assembled using components from kit 30 (described below) in two basic configurations: center-mounted 40, in FIG. 1 and left-mounted 402 in FIG. 2. The instrument can have a top plate 76 and a bottom plate 78. A combined finished device 40 in FIG. 22 shows device 40 as a one piece custom chinrest manufactured from the results of the method to create the device (described below), the top views representing a full configuration and the lower figures a fractional configuration.

Figure 5:
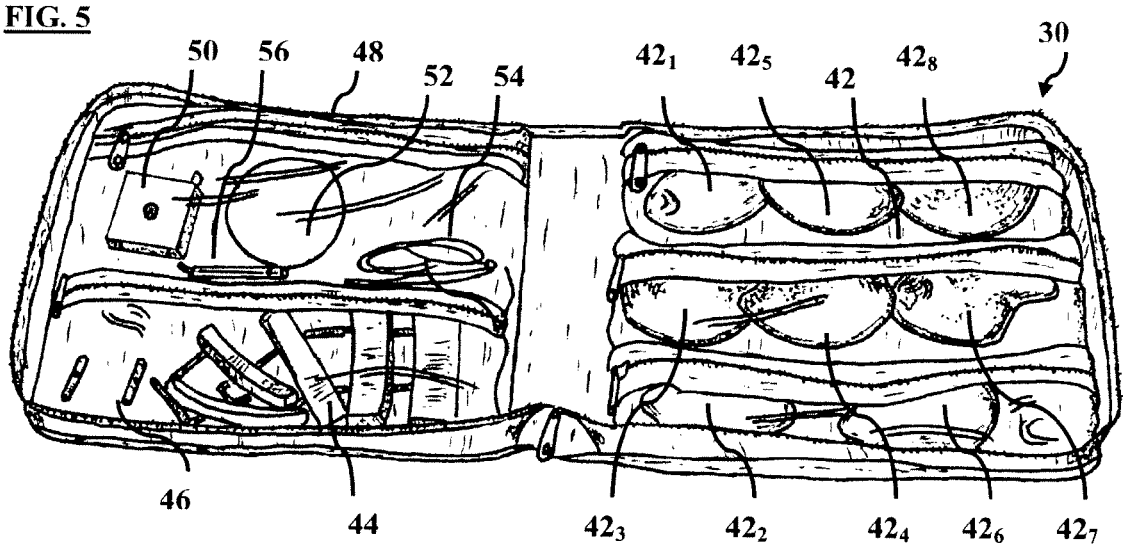
FIG. 5 illustrates a diagnostic chinrest fitting kit of one embodiment of the present invention.
Figure 6:
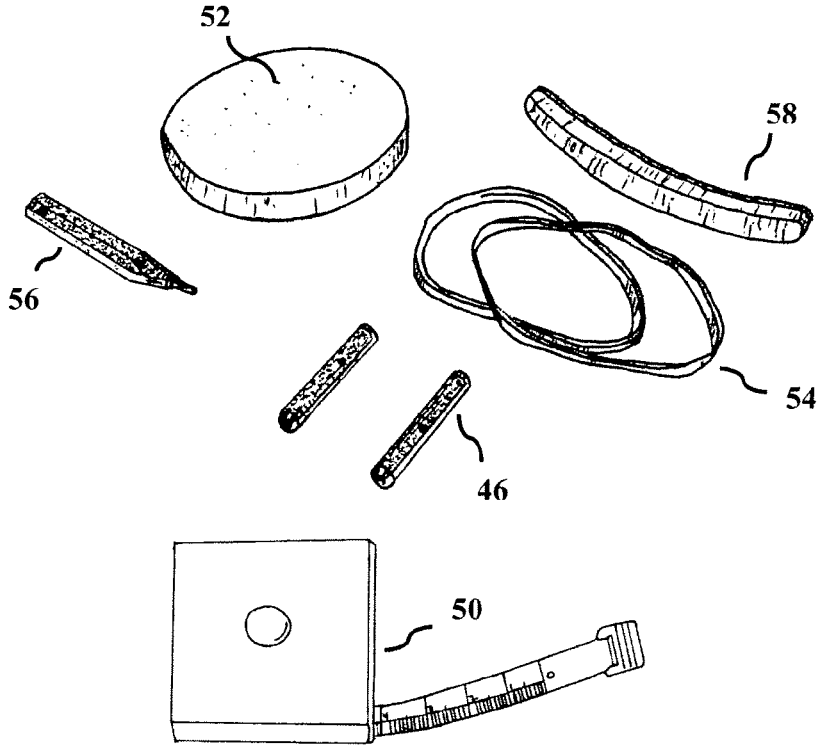
FIG. 6 illustrates a diagnostic chinrest fitting kit contents without toppers and with one non-metal supported lift of one embodiment of a device of the present invention.
Figure 7:
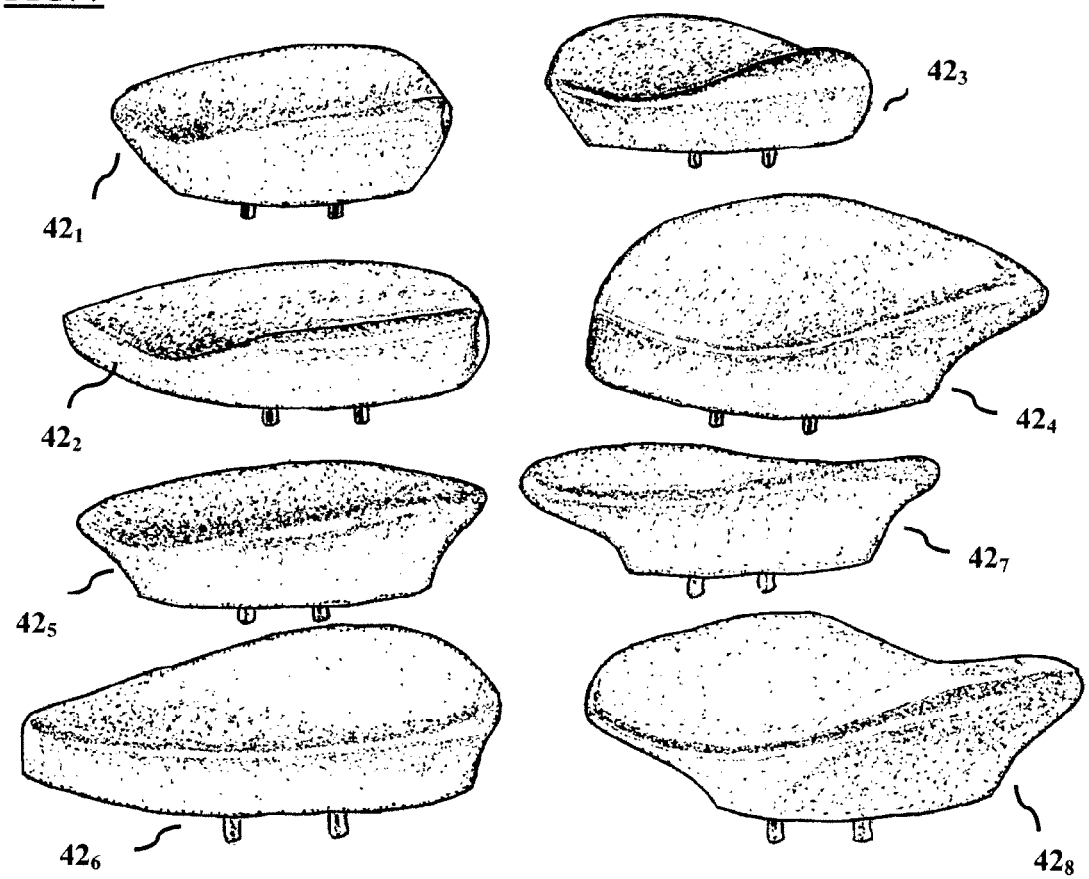
FIG. 7 illustrates a diagnostic chinrest fitting kit contents without tools and lifts of one embodiment of a device of the present invention.
Figure 8:
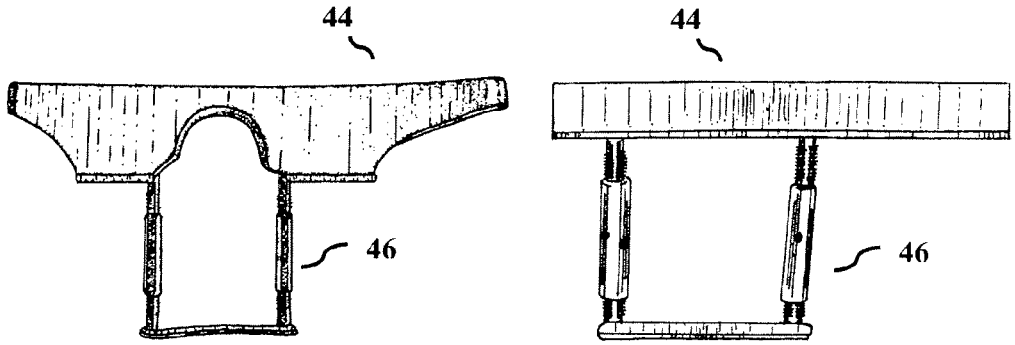
FIG. 8 illustrates a diagnostic chinrest fitting kit contents without tools and toppers of one embodiment of a kit of the present invention.

Referring namely now to FIG. 5, there is shown a diagnostic chinrest fitting kit generally indicated at 30 that is within the scope of the present invention. It is noted that this kit is exemplary in nature, and many variations of the kit are possible and still fall within the scope of the invention. The key components of kit 30 can include the tops of chinrests ("toppers") generally shown at 42 and individually at 42, through 428 of various ergonomic designs, and risers ("lifts") generally shown at 44 and individually (individually at 44, through 448) at sizes 5 mm (left-mounted only), 10 mm (left-mounted only), 15 mm (left-mounted only), 20 mm (left-mounted), 20 mm (center-mounted), 25 mm (left-mounted), 25 mm (center-mounted). Lifts 44 are placed under the toppers 42 to the center or at the left of the violin or viola plus accessory tools that allow teachers and players to ascertain, as described below, what shape of chinrest, what height of chinrest, and what placement are needed for an ergonomic fit and to attach one part to the other. These tools can include at least one barrel 46, carrying case 48, 50, Tape measure 52, Cosmetic sponge 54, Rubber bands 56, Chinrest key, and cork 58. Optionally, the kit can include a camera (not shown) and a booklet describing the method to assemble a customized chinrest (not shown).

Figure 9:
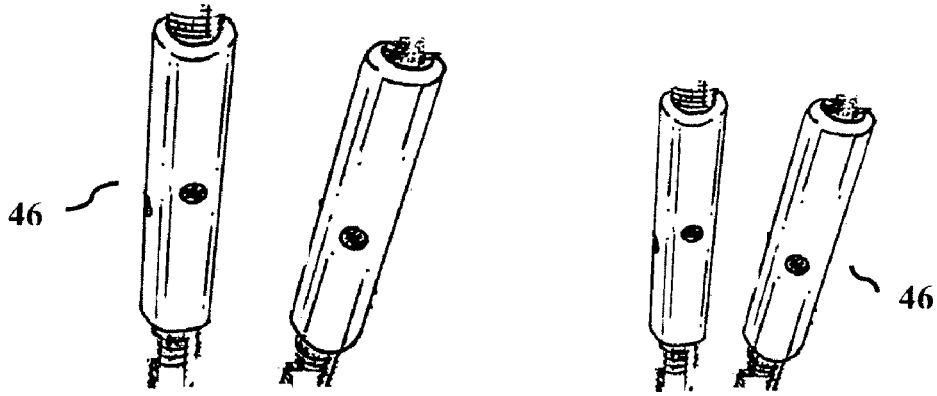
FIG. 9 illustrates an enlarged version of viola and violin barrels of one embodiment of a device of the present invention.
Figure 10:
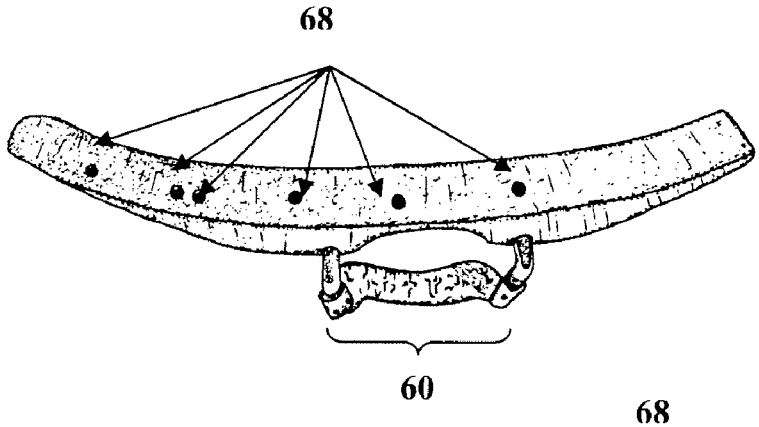
FIG. 10 illustrates center-mounted and left-mounted lifts showing post holes of one embodiment of a device of the present invention.
Figure 10:
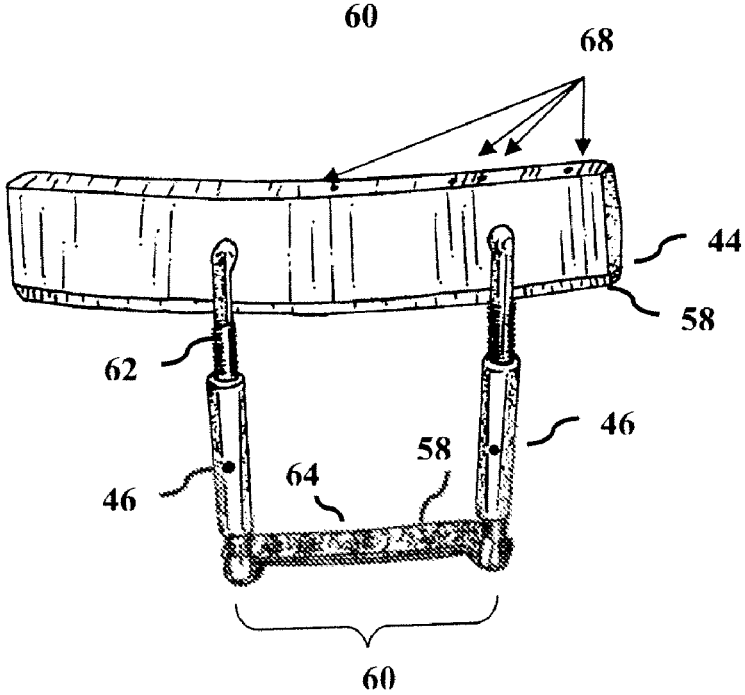
Figure 11:
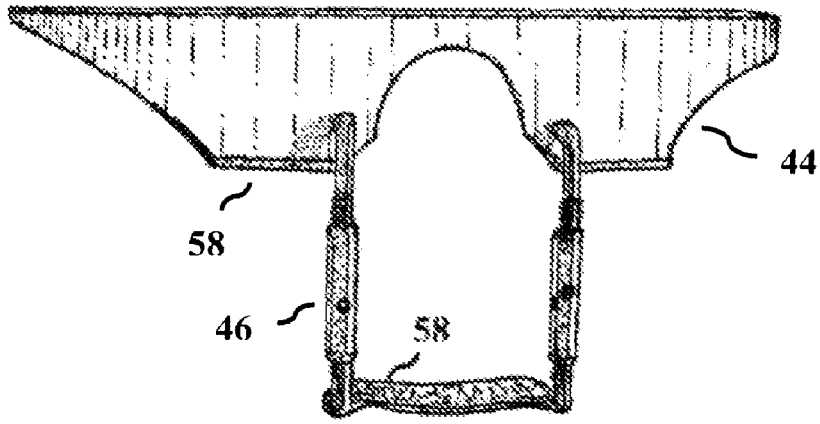
FIG. 11 illustrates center-mounted and left-mounted lifts showing cork of one embodiment of a device of the present invention.
Figure 11:
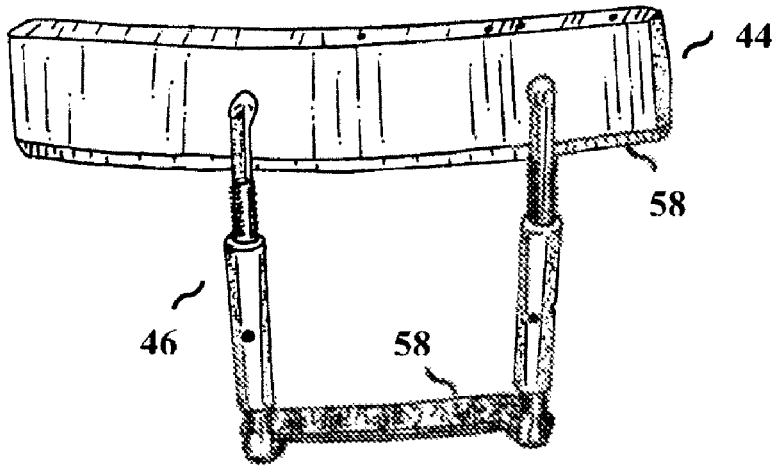
Figure 12:
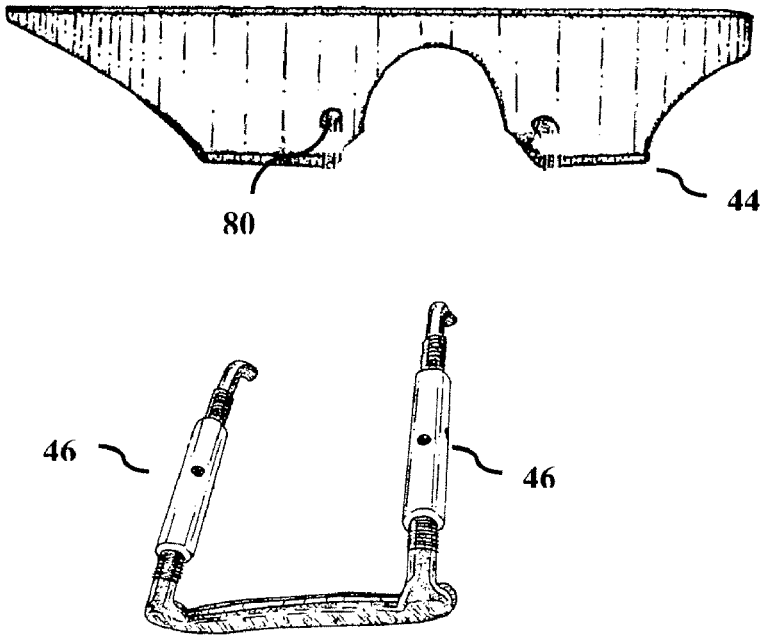
FIG. 12 illustrates a center-mounted lift and lift hardware, exploded view, of one embodiment of a device of the present invention.
Figure 13:
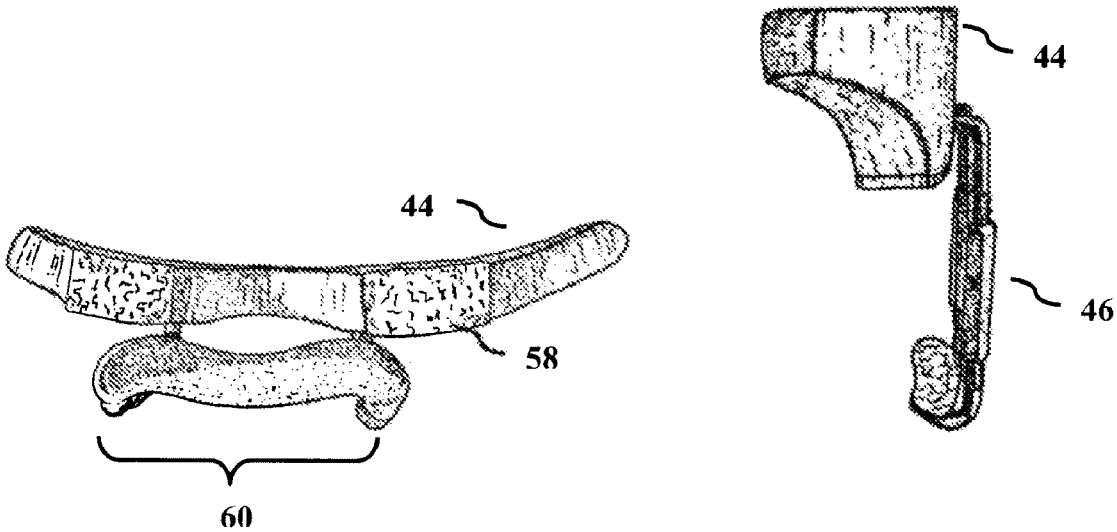
FIG. 13 illustrates a center-mounted lift, underside and side views, of one embodiment of a device of the present invention.
Figure 14:
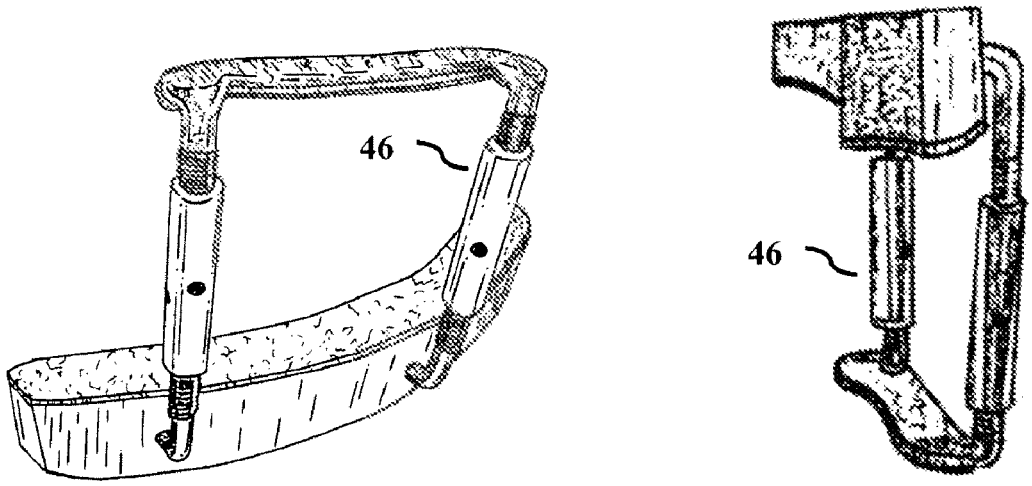
FIG. 14 illustrates a left-mounted lift, underside and side views, of one embodiment of a device of the present invention.
Figure 15:
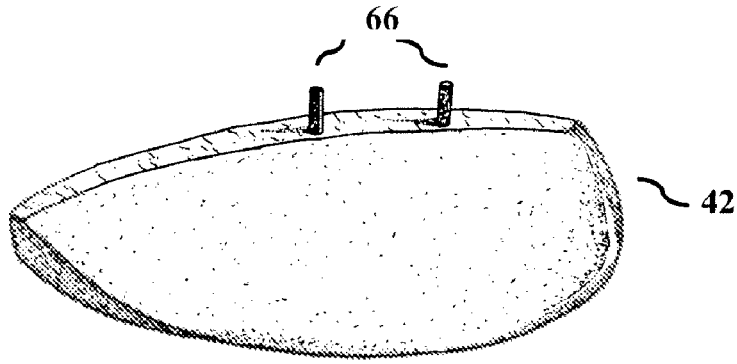
FIG. 15 illustrates a topper and posts, underside view, of one embodiment of a device of the present invention.
Figure 16:
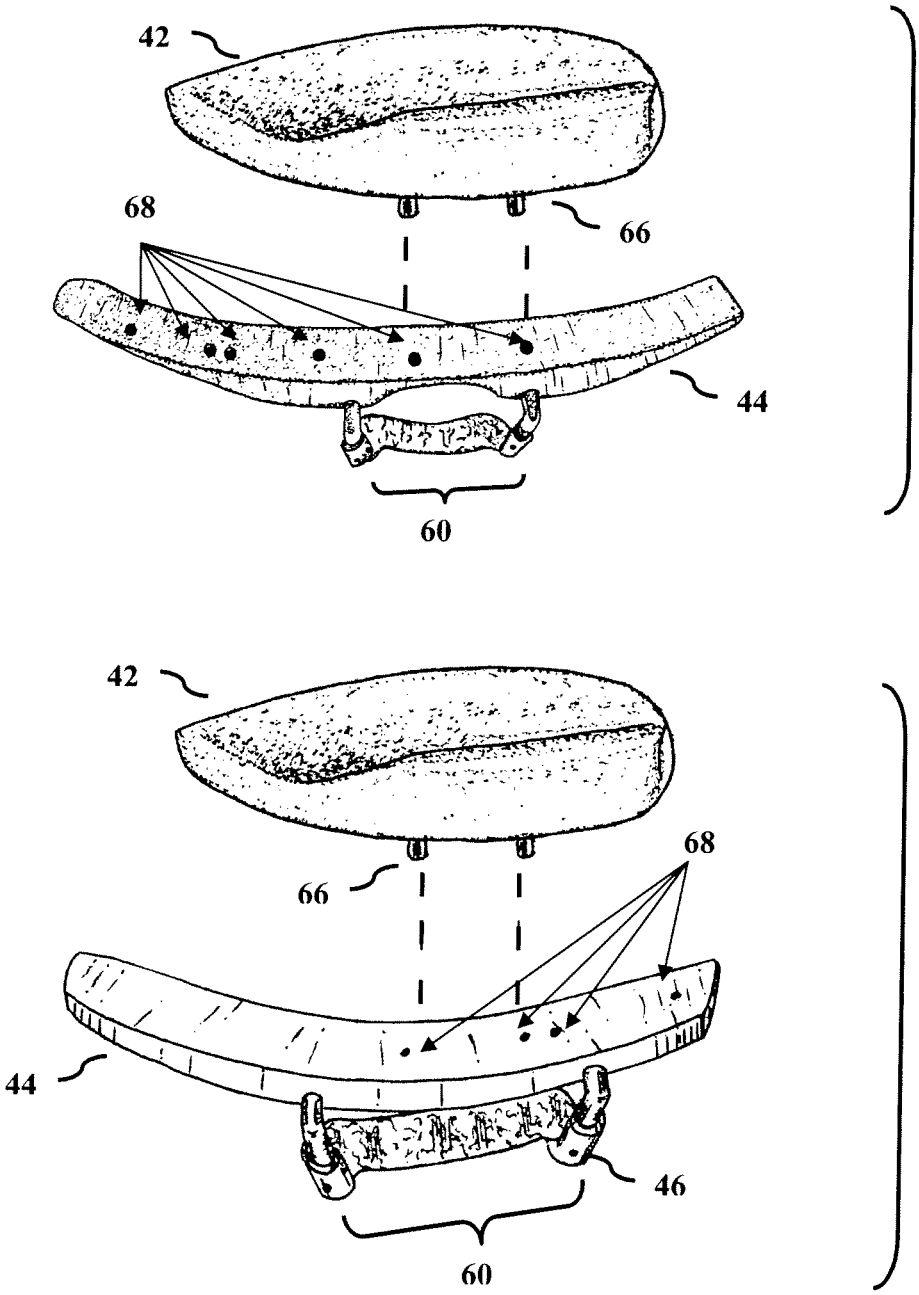
FIG. 16 illustrates center-mounted and left-mounted lifts and toppers, exploded view, of one embodiment of a device of the present invention.
Figure 17:
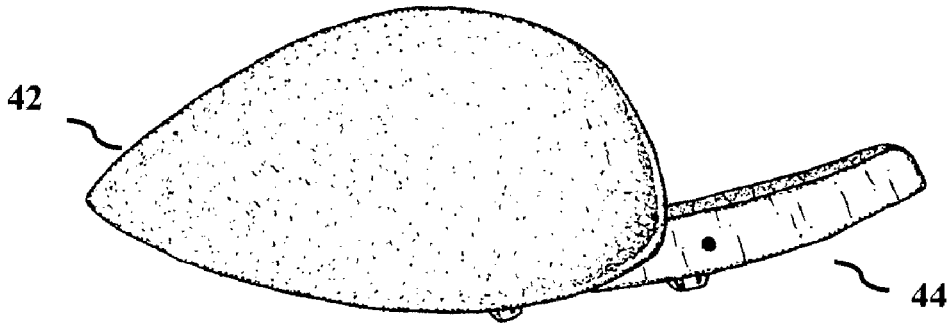
FIG. 17 illustrates a center-mounted lift, farthest left placement of topper, top view of one embodiment of a device of the present invention.
Figure 18:
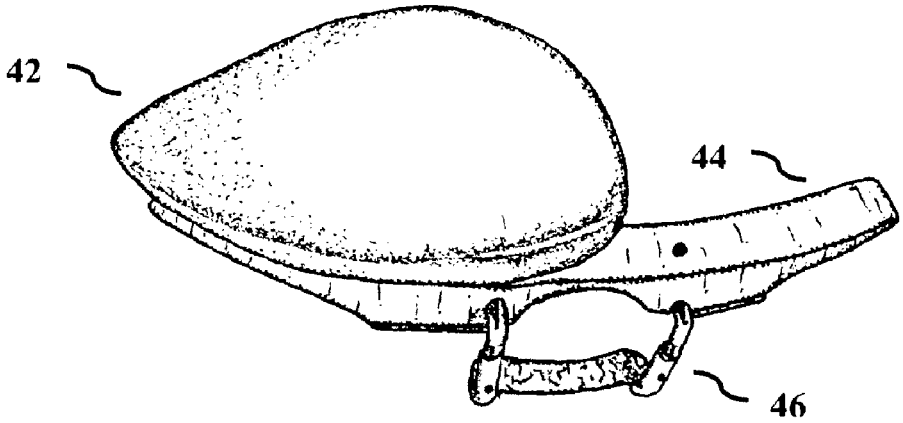
FIG. 18 illustrates a center-mounted lift, farthest left placement of topper, top and back view, of one embodiment of a device of the present invention.
Figure 19:
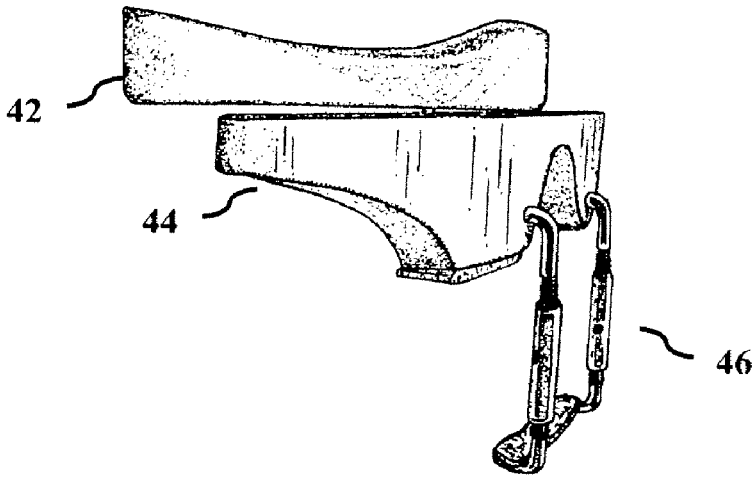
FIG. 19 illustrates a center-mounted lift, farthest left placement of topper, side view, of one embodiment of a device of the present invention.
Figure 20:
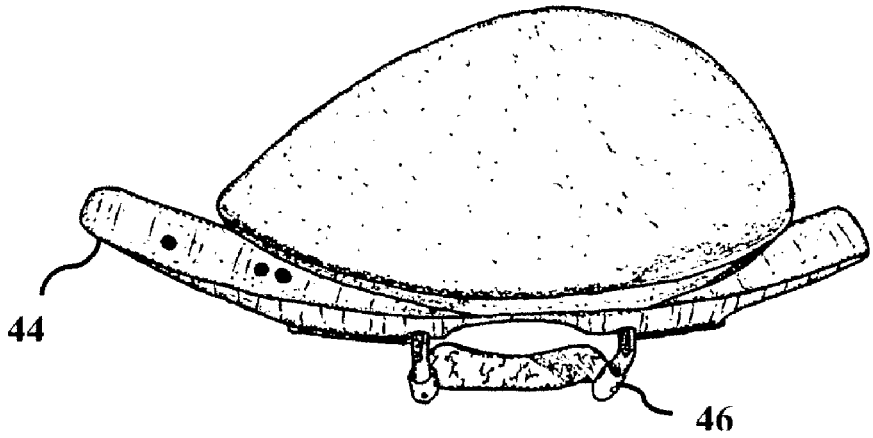
FIG. 20 illustrates a center-mounted lift, farthest right placement of topper, top view, of one embodiment of a device of the present invention.
Figure 21:
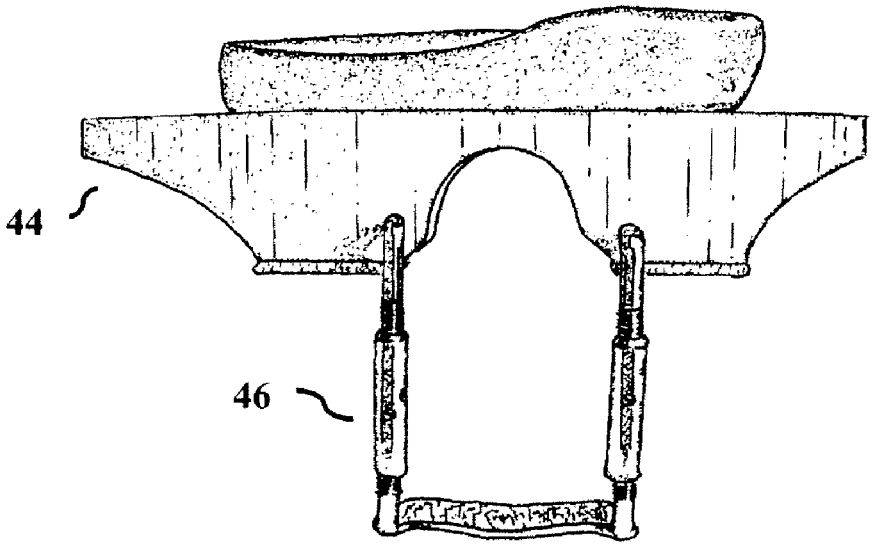
FIG. 21 illustrates a center-mounted lift, farthest right placement of topper, back view, of one embodiment of a device of the present invention.

Referring to lifts 44, lifts 44 can be attached to instrument 38 with the lift hardware 60 generally shown in FIG. 10. and thereafter. Lift hardware 60 can include barrels 46 provided in kit 30 sized for violin (on right, FIG. 9) or viola (on left, FIG. 9). Lift hardware can also include upper lift threaded members 62 to attach to lift 44 at lift hardware attachment holes 80 (see FIG. 12) and lower lift threaded member 64 to connect lift hardware 60 to instrument 38. Instrument 38 may be protected by including cork 58 between the underside of lift 44 and the lower lift threaded member 64 (i.e., where device 40 touches instrument 38). Chinrest key 56 is used to clamp device 40 onto the instrument. Also, as shown in FIG. 16, lifts 44 can have a plurality of lift topper holes 68 corresponding to various placement of topper pins 66 described below. In one embodiment of the invention, construction features include at least three sets of lift holes 68 on the center-mounted configuration and at least two sets of lift holes 68 on the left-mounted configuration.

Referring to toppers 42, a plurality of shapes and sizes may be provided to accommodate a wide variety of users. As part of a device assembly using kit 30, pins 66 can be included to correspond to the series of lift holes 68 described above. Toppers 42 can be of wood or similar rigid-type materials known in the art. Topper pins 66 can be made of brass wire or any other wire-like material. Further, as shown in FIG. 1, where lift 44 is to be attached to an instrument center 72, lift 44 can have an arch 70 to arch over its bridge.

Included as part of the present invention can be a method for the development and installation of the chinrest device. The device 40 can be assembled from kit 30 using a plurality of shapes of adult and child-size chinrests.

The first step can be determining whether a center mounted (FIG. 1) or left-mounted (FIG. 2) chinrest is most appropriate for a user of instrument 38. This can be accomplished by discussing with the instrument user any current pain or problems while playing, observing student play, and looking for a preference for center or left jaw placement.

The next step can be removing old chinrest and shoulder rest, if present.

The next step can be photographing a user with a camera (not shown). Positions can include: the user's back without instrument for spine alignment; the user's back with instrument in playing position; the scroll (the top of the instrument where the strings are tuned) pointing right of the camera to see if the neck of the instrument is drooping; the scroll pointing toward the camera (to determine roll of the instrument); and with the student face-forward to the camera (determines tilt of face). Photos can be downloaded to a computer, and angles are calculated.

The next step can be measuring a user's neck from bottom of left jaw to top of the left collarbone (neck height) using tape measure 50.

The next step can be measuring instrument from the top of the top plate 76 (where chin rest would be attached) to bottom of the bottom plate of the instrument 78 (see FIGS. 1-4).

The next step can be subtracting instrument height from neck height.

The next step can be assembling a trial chinrest from kit 30 using a lift 44 chosen for center or left mounting based on prior step and for height that is approximately 20 mm less than the number obtained from the previous step. Assembling also includes selecting a barrel 46 length appropriate for the instrument and connecting barrels 46 to lift hardware 60, including upper lift threaded members 62 and lower lift threaded member 64. Cork 58 can also be positioned where the lift hardware attaches to instrument 38.

The next step can be attaching the trial chinrest to the instrument and attaching to the instrument using sponge 52 to go between instrument 38 to the user's collarbone and the instrument/chinrest assembly held in place by the rubber bands 54. Barrels 46 are loosened or tightened on the chinrest hardware using the chinrest key 56 to clamp lift hardware 60 onto the instrument top plate 76 and bottom plate 78.

The next step can be choosing a topper by analyzing fit and comfort for height and contour of the chin. This can be accomplished by placing a topper 42 in the top of lift 44 chosen based on physical configuration of the student. One by one, a topper 42 is added to lift 44 just before carefully placing the instrument on the player's left collarbone close to the neck. Selection consideration includes the flexibility of the left arm and the length of the smallest finger of the player. A test set of lift holes 68 are also chosen, and topper 42 is analyzed for lateral fit by moving the topper 42 left or right from one set of post holes 68 to another. This can be accomplished by placing the instrument on the user's right hipbone in a resting position, as is known in the art, while the student places his thumb on the back curve of the neck where it attaches to the instrument body. Next, the user reaches with his left hand fingers up and over the fingerboard and expands his fingers on the left side of the fingerboard, then moving his right hand from his hip to grasp the instrument, while keeping left hand fingers in place, moving instrument on top his collarbone, while keeping face forward, then moving his head to face fingerboard, dropping his chin onto the chinrest.

The last step can be the manufacturing of a finished device 40 as a single, one-piece unit having the proper height, shape, size, and lift to allow proper placement on the instrument.

The description of the present invention herein is presented to enable any person skilled in the art to make and use the invention and is provided in the context of particular applications of the invention and their requirements. Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein.

LIST OF ELEMENTS

| | |
|---|---|
| 30 | Kit |
| 38 | Instrument |
| 40 | Device |
| 42 | Topper |

-continued

| | |
|---|---|
| 44 | Lift |
| 46 | Barrels |
| 48 | carrying case |
| 50 | Tape measure |
| 52 | Cosmetic sponge |
| 54 | Rubber bands |
| 56 | Chinrest key |
| 58 | Cork |
| 60 | Lift hardware |
| 62 | Upper Lift threaded members |
| 64 | Lower Lift threaded member |
| 66 | Topper pins |
| 68 | Lift topper holes |
| 70 | Lift arch |
| 72 | Instrument center |
| 74 | Instrument bridge |
| 76 | Instrument top plate |
| 78 | Instrument bottom plate |
| 80 | Lift hardware attachment holes |

We claim:

1. An assembled chinrest device for a musical instrument customized to proper height, shape, size, and placement of the chinrest, comprising:

a topper having plural topper pins;

a lift having lift topper holes placed to receive said topper pins, and having at least one lift hardware attachment hole; and lift hardware comprising a threaded barrel configured to receive at one end a first end of an upper lift threaded member and configured to receive at a second end a lower lift threaded member, said upper lift threaded member having a second end received within said lift hardware attachment hole, wherein attachment of the lift hardware to said lift enables the chinrest device to be clamped onto a top plate and bottom plate of the instrument.

2. The chinrest of claim 1, further comprising an elastic band to attach said device to said instrument.

3. The chinrest of claim 1, further comprising cork to place between where the instrument and the device make contact.

4. The chinrest of claim 1, further comprising an arch on the lift whereby the device can be placed over the center of the instrument without contacting an instruments tailpiece.

5. A kit to assemble a chinrest device for a musical instrument customized to proper height, shape, size, and placement of the chinrest, comprising:

a plurality of toppers based on various jaw configuration possibilities for a user, said toppers having at least one pin;

a plurality of lifts to allow selection of height of the chinrest, said lifts also varied to allow placement around to a left or center of the instrument, said lifts having a plurality of holes or hole sets to allow various attachment points of said topper;

lift hardware to attach said lifts to said instrument, including at least one threaded barrel configured to receive at one end a first end of an upper lift threaded member and configured to receive at a second end a lower lift threaded member, said upper lift threaded member having a second end to attached within said lift hardware attachment hole;

a carrying case;

a tape measure;

a cosmetic sponge;

at least one elastomeric band;

a barrel key; and cork.

6. The kit of claim 5, further comprising a camera.

7. A method to assemble a chinrest device for a musical instrument customized to proper height, shape, size, and placement of the chinrest, comprising the steps of:

determining whether a center-mounted or left-mounted chinrest is most appropriate for a user of instrument;

measuring a user's neck from bottom of left jaw to top of the left collarbone to obtain a neck height;

measuring the instrument from the top of the top plate to the bottom of the bottom plate to obtain an instrument height;

subtracting instrument height from neck height;

assembling a trial chinrest with a test topper from kit having a plurality of toppers, a lift approximately 20 mm less than the number obtained from subtracting the instrument height from neck height when combined with said topper, and lift hardware to allow attachment of trial chinrest to said instrument;

attaching said trial chinrest to the instrument;

choosing a topper by analyzing fit and comfort for height and contour of the chin; and choosing a lateral attachment point of said topper to said lift considering the flexibility of the user's left arm and the length of the smallest finger of the player.

8. The method of claim 7, whereby the step of determining whether a center-mounted or left-mounted chinrest is most appropriate for a user of an instrument is achieved by discussing with the instrument user any current pain or problems while playing, observing student playing, showing a preference for center or left jaw placement.

9. The method of claim 7, further comprising the step of removing an old chinrest and shoulder rest, if present.

10. The method of claim 7, further comprising the step of manufacturing a finished device as a single, one-piece unit having the proper height, rigidity, shape, size, and lift to allow proper placement on the instrument.

11. The method of claim 7, further comprising the step of photographing a user with a camera.

12. The method of claim 11, wherein said photographing includes the user's back without instrument; the user's back with instrument in playing position; the scroll pointing right of the camera; the scroll pointing toward the camera; and the user facing forward to the camera.

13. The method of claim 11, wherein the step of choosing a lateral attachment point of said topper to said lift is by choosing a test set of lift holes on said lift by placing the instrument on right hipbone on the user in a resting position, while placing a thumb on the back curve of an instrument neck where it attaches to the instrument body; reaching with left hand fingers up and over a fingerboard and expanding his fingers on the left side of the fingerboard, then moving his right hand from hip to grasp the instrument while keeping left hand fingers in place, moving instrument on top of his collarbone while keeping face forward, then moving his head to face the fingerboard, dropping his chin onto the chinrest.

* * * * *